US008662055B2

(12) United States Patent
Kabrich et al.

(10) Patent No.: US 8,662,055 B2
(45) Date of Patent: Mar. 4, 2014

(54) ENGINE SYSTEM HAVING FAILURE-PROTECTED AIR SHUTOFF CONTROL

(75) Inventors: Todd Ryan Kabrich, Mapleton, IL (US); Matthew Christopher Greving, Washington, IL (US); Eric John Kuester, East Peoria, IL (US); Scott Allen Weiss, Washington, IL (US)

(73) Assignee: Caterpillar Inc., Poeria, IL (US)

( * ) Notice: Subject to any disclaimer, the term of this patent is extended or adjusted under 35 U.S.C. 154(b) by 304 days.

(21) Appl. No.: 13/072,163

(22) Filed: Mar. 25, 2011

(65) Prior Publication Data

US 2012/0240899 A1 Sep. 27, 2012

(51) Int. Cl.
*F02D 9/08* (2006.01)

(52) U.S. Cl.
USPC ..... 123/397; 123/198 D

(58) Field of Classification Search
USPC ..... 123/350–351, 360–361, 397–400, 198 D
See application file for complete search history.

(56) References Cited

U.S. PATENT DOCUMENTS

| | | | | |
|---|---|---|---|---|
| 3,621,824 | A * | 11/1971 | Burnia et al. | 123/339.11 |
| 3,974,879 | A * | 8/1976 | Nelson et al. | 169/43 |
| 4,020,814 | A | 5/1977 | Hewitt et al. | |
| 4,102,316 | A | 7/1978 | Valbert | |
| 4,129,040 | A * | 12/1978 | Hayden, Jr. | 73/507 |
| 4,854,283 | A | 8/1989 | Kiyono et al. | |
| 4,924,827 | A | 5/1990 | Minegishi | |
| 5,070,832 | A | 12/1991 | Hapka et al. | |
| 6,276,328 | B1 * | 8/2001 | Denton et al. | 123/198 D |
| 6,529,815 | B2 | 3/2003 | Hawkins et al. | |
| 6,658,345 | B2 | 12/2003 | Miller | |
| 6,941,245 | B2 | 9/2005 | Longnecker et al. | |
| 7,072,761 | B2 | 7/2006 | Hawkins et al. | |
| 7,204,230 | B2 | 4/2007 | Bevan et al. | |
| 7,207,309 | B2 * | 4/2007 | Adams et al. | 123/198 D |
| 7,349,794 | B2 | 3/2008 | Malone et al. | |
| 7,444,982 | B2 | 11/2008 | Rivet | |
| 7,584,742 | B2 | 9/2009 | Bauerle et al. | |
| 2008/0073605 | A1 | 3/2008 | Ishigaki et al. | |

FOREIGN PATENT DOCUMENTS

| | | |
|---|---|---|
| JP | 07077082 | 8/1995 |
| KR | 1020030029667 | 4/2003 |

OTHER PUBLICATIONS

LEBH4623-02, Caterpillar Industrial Engine Electronics Application and Installation Guide, pp. 1-162; ww.cat-industrial.com (2008).

* cited by examiner

*Primary Examiner* — Hai Huynh
(74) *Attorney, Agent, or Firm* — Finnegan, Henderson, Farabow, Garrett & Dunner LLP

(57) ABSTRACT

An engine system is disclosed. The engine system may have an engine, an intake duct, and a valve disposed within the intake duct and movable between a flow-passing first position, and a flow-blocking second position. The engine system may also have an actuator configured to move the valve from the second position toward the first position, and a biasing element configured to move the valve from the first position toward the second position. The engine system may additionally have a sensor configured to sense an operating condition of the engine, and a controller. The controller may be configured to receive an input indicative engine activation, and to activate the actuator based on the input. The controller may also be configured to make a determination that the operating condition of the engine has deviated from a desired operating condition, and to deactivate the actuator based on the determination.

13 Claims, 2 Drawing Sheets

ENGINE SYSTEM HAVING FAILURE-PROTECTED AIR SHUTOFF CONTROL

TECHNICAL FIELD

The present disclosure is directed to an engine system and, more particularly, to an engine system having air shutoff control that provides engine protection in the event of a system failure.

BACKGROUND

Internal combustion engines, including diesel engines, gasoline engines, gaseous fuel-powered engines, and other engines known in the art are generally designed to operate within a particular speed range. When an engine operates uncontrollably at a speed greater than the design range, the engine is considered to be "running away". As an engine runs away, forces acting on components of the engine can increase to damaging levels. One situation in which an engine can run away includes operation of the engine within potentially explosive atmospheres, such as those found in petroleum, coal, or natural gas mining and reclamation applications. In these atmospheres, it may be possible for the engine to draw in and combust hydrocarbons from the atmosphere in an unregulated manner, thereby causing the engine to overfuel and speed past its intended design range.

Historically, a run-away engine was shut down manually to reduce damage to the engine caused by excessive speeds. In particular, when an engine was determined to be running away, an operator of the engine could manually move a valve or gate to block air (or air and fuel) flow into the engine, thereby shutting the engine down. Although this manual process was effective, it was error prone and often involved operator delay in detecting the run-away condition and activating the shutoff valve.

One attempt to improve shutdown of a run-away engine operating in a potentially explosive atmosphere is described in U.S. Pat. No. 7,444,982 issued to Rivet on Nov. 4, 2008 (the '982 patent). In particular, the '982 patent discloses a hydro-mechanical air shutoff for an internal combustion engine. The hydro-mechanical air shutoff includes a shutoff device connected to an air valve disposed within an intake of an engine, and a flyweight valve spool fluidly connected to the shutoff device. During an overspeed condition, the flyweight valve spool is caused to move by centrifugal force and block a passageway leading from the shutoff device, thereby causing system pressure to increase to a point where the shutoff device pushes the air valve closed and shuts down the engine.

SUMMARY

One aspect of the present disclosure is directed to an engine system. The engine system may include an engine, an intake duct fluidly connected to the engine, and a valve disposed within the intake duct. The valve may be movable between a flow-passing first position, and a flow-blocking second position. The engine system may also include an actuator selectively activated to move the valve from the second position toward the first position, and a biasing element configured to move the valve from the first position toward the second position when the actuator is deactivated. The engine system may additionally include a sensor configured to sense an operating condition of the engine and generate a signal indicative of the operating condition, and a controller in communication with the actuator and the sensor. The controller may be configured to receive an input indicative of engine activation, and to activate the actuator based on the input. The controller may also be configured to make a determination that the operating condition of the engine has deviated from a desired operating condition based on the signal, and to deactivate the actuator based on the determination.

Another aspect of the present disclosure is directed to a method of operating an engine system. The method may include receiving an input indicative of engine system activation and, based on the input, activating an air shutoff device to allow air to flow into the engine system. The method may further include sensing an operating parameter of the engine system, making a determination that an operating condition of the engine system has deviated from a desired operating condition based on the operating parameter and, based on the determination, deactivating the air shutoff device to block air flow into the engine system.

DETAILED DESCRIPTION

Figure 1:
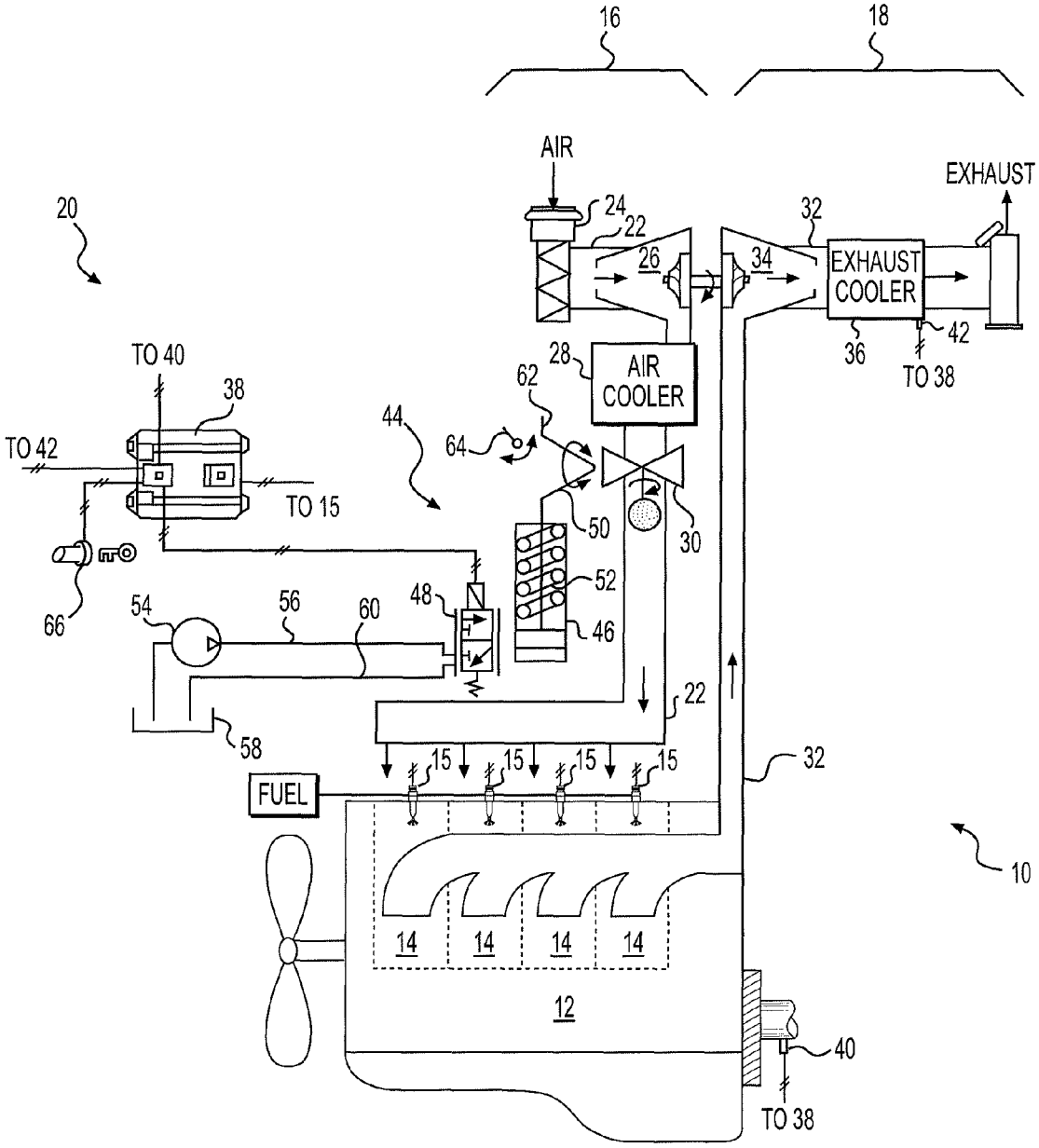
FIG. 1 is a schematic and diagrammatic illustration of an exemplary disclosed engine system.

FIG. 1 illustrates an exemplary engine system 10. For the purposes of this disclosure, engine system 10 is depicted and described as a diesel-fueled, internal combustion engine. However, it is contemplated that engine system 10 may embody any other type of combustion engine such as, for example, a gasoline engine or a gaseous fuel-powered engine burning compressed or liquefied natural gas, propane, or methane. Engine system 10 may include an engine block 12 that at least partially defines a plurality of combustion chambers 14, and a plurality of fuel injectors 15 configured to inject desired quantities of the fuel into each combustion chamber 14 at desired timings. It is contemplated that engine system 10 may include any number of combustion chambers 14 and that combustion chambers 14 may be disposed in an "in-line" configuration, a "V" configuration, or in any other conventional configuration.

Multiple separate sub-systems may be included within engine system 10. For example, engine system 10 may include, among others, an air induction system 16, an exhaust system 18, and a control system 20. Air induction system 16 may be configured to direct air to mix with fuel from injectors 15 within combustion chambers 14 of engine system 10 for subsequent combustion. Exhaust system 18 may exhaust byproducts of the combustion to the atmosphere. Control system 20 may regulate operations of fuel injectors 15, air induction system 16, and/or exhaust system 18.

Air induction system 16 may include multiple components that cooperate to condition and introduce compressed air into combustion chambers 14. For example, air induction system 16 may include an inlet duct 22 configured to direct air that has been received by way of a filter 24 through a compressor 26 and into combustion chambers 14. In some embodiments, an air cooler 28 may be located downstream of compressors 26 to chill air pressurized by compressor 26 before the air enters combustion chambers 14. Air induction system 16 may also include an air shutoff valve 30 disposed within intake duct 22, for example downstream of air compressor 26 and air cooler 28. It should be noted that air shutoff valve 30 may be disposed at any location within intake duct 22 such as upstream of air compressor 26 and/or air cooler 28, if desired.

As will be described in more detail below, air shutoff valve 30 may be configured to selectively regulate (i.e., restrict or completely block) the flow of inlet air into engine system 10. A restriction of the inlet air may result in less air entering engine system 10 and, thus, affect an air-to-fuel ratio of engine system 10. It is contemplated that compressor 26 and/or cooler 28 may be omitted, if a naturally aspirated engine system 10 is desired.

Air shutoff valve 30 may embody any type of device capable of regulating the flow of air into combustion chambers 14. In the disclosed embodiment, air shutoff valve may be a butterfly-type of valve that is movable (e.g., rotatable) between a flow-passing first position (not shown) at which air flow into combustion chambers 14 is substantially unrestricted by air shutoff valve 30, and a flow-blocking second position (shown in FIG. 1) at which substantially all air flow through intake duct 22 into combustion chambers 14 is inhibited. Air shutoff valve 30 may be moved to any position between the first and second positions, to thereby vary an amount of restriction placed on the flow of air within intake duct 22. It should be noted that when air shutoff valve 30 is fully in the second position and substantially all air flow through intake duct 22 is inhibited, operation of engine system 10 may be terminated. That is, the air-to-fuel ratio of engine system 10 may be insufficient to support combustion within combustion chambers 14 when air shutoff valve 30 is in the second position.

Exhaust system 18 may include multiple components that condition and direct exhaust from combustion chambers 14 to the atmosphere. For example, exhaust system 18 may include an exhaust duct 32 configured to direct the byproducts of combustion from combustion chambers 14 through a turbine 34 to the atmosphere. Turbine 34 may be mechanically connected to drive compressor 26 and pressurize air as a flow of heated exhaust gases passes through turbine 34. In some embodiments, an exhaust cooler 36 may be located within exhaust duct 32 to chill exhaust received from turbine 34 before discharge to the atmosphere. As will be described in more detail below, the use of engine system 10 in some applications (e.g., in explosive atmospheric applications), may require the exhaust to be chilled before discharge to the atmosphere so as to sufficiently reduce a possibility of atmospheric detonations. It is contemplated that turbine 34 and/or cooler 36 may be omitted, if desired.

Control system 20 may include components configured to regulate operation of air induction and exhaust systems 16, 18. Specifically, control system 20 may include a controller 38 in communication with one or more engine sensors 40, one or more temperature sensors 42, injectors 15, and an actuator 44 associated with air shutoff valve 30. Based on input from engine sensor 40 and/or temperature sensor 42, controller 38 may be configured to determine the existence of an engine system run-away condition and/or an undesired thermal condition, and then regulate operation of injectors 15 and/or actuator 44 to derate or completely terminate operation of engine system 10.

Controller 38 may embody a single or multiple microprocessors, field programmable gate arrays (FPGAs), digital signal processors (DSPs), etc. that include a means for controlling an operation of engine system 10 in response to signals received from the various sensors. Numerous commercially available microprocessors can be configured to perform the functions of controller 38. It should be appreciated that controller 38 could readily embody a microprocessor separate from that controlling other non-speed or temperature related engine system functions, or that controller 38 could be integral with a general engine system microprocessor and be capable of controlling numerous engine system functions and modes of operation. If separate from the general engine system microprocessor, controller 38 may communicate with the general engine system microprocessor via datalinks or other methods. Various other known circuits may be associated with controller 38, including power supply circuitry, signal-conditioning circuitry, actuator driver circuitry (i.e., circuitry powering solenoids, motors, or piezo actuators), communication circuitry, and other appropriate circuitry.

Engine sensor 40 may embody a magnetic pickup-type sensor configured to provide an indication as to a rotational speed of engine system 10. In one example, sensor 40 may include a Hall-effect element (not shown) disposed proximate a magnet (not shown) embedded within a rotating element of engine system, for example a crankshaft, flywheel, or encoder wheel. In this position, the Hall-effect element may sense a rotational speed of engine system 10 and produce a corresponding speed signal. Alternatively, speed sensor 40 may embody another type of sensor, for example an optical sensor, a radio frequency sensor, or another type of sensor, if desired. The signal from sensor 40 may be directed to controller 38 for processing and control purposes.

Temperature sensor 42 may be configured to generate a signal indicative of a temperature of exhaust exiting cooler 36. In one example, temperature sensor 42 may be located within a downstream portion of exhaust cooler 36. In another example, temperature sensor 42 may be located within exhaust duct 32. In either configuration, temperature sensor 42 may direct the temperature signal to controller 38 for processing and control purposes.

It is contemplated that sensors 40 and/or 42 may embody virtual sensors rather than physical sensors, if desired. A virtual sensor may be a model-driven estimate based on one or more known or sensed operational parameters of engine system 10. For example, based on a known operating speed, load, inlet temperature, boost pressure, and/or other parameter of engine system 10 and/or exhaust cooler 36, a model may be referenced to determine the exhaust temperature downstream of exhaust cooler 36. The same or another model may be utilized in a similar manner to predict or estimate the speed of engine system 10, if desired. Accordingly, the signal (s) directed from sensors 40, 42 to controller 38 could be based on calculated or estimated values rather than direct measurements.

Actuator 44 may be an assembly of components regulated by controller 38 to move air shutoff valve 30 between the first (i.e., flow-passing) and second (i.e., flow-blocking) positions. In the disclosed embodiment, actuator 44 may include a single-acting hydraulic cylinder 46 that is configured to move shutoff valve 30 toward the second position when supplied with pressurized fluid (i.e., when activated), and a solenoid valve 48 that selectively meters pressurized fluid into and out of hydraulic cylinder 46. For example, hydraulic cylinder 46 may be connected to air shutoff valve 30 by way of a linkage member 50, such that when hydraulic cylinder 46 extends under the force of fluid pressure, linkage member 50 translates the extension to or otherwise facilitates a rotation of shutoff valve 30 toward the flow-passing first position. A return spring 52 or other biasing element may be associated with hydraulic cylinder 46 (shown in FIG. 2) and/or with shutoff valve 30 to urge shutoff valve 30 toward the flow-blocking second position when hydraulic cylinder 46 is deactivated (i.e., drained of pressurized fluid). It should be noted that other types of actuators may alternatively be utilized to move air shutoff valve 30, if desired.

Solenoid valve 48 may be an independent metering valve configured to meter pressurized fluid into and out of hydraulic cylinder 46 based on a command from controller 38 (i.e., when energized by controller 38). In the disclosed embodiment, solenoid valve 48 may include a single valve element movable between a first position at which fluid from a high-pressure supply 54 (e.g., from a pump driven by operation of engine system 10) may be directed into hydraulic cylinder 46 via a supply passage 56, and a second position at which fluid from within hydraulic cylinder 46 may pass to a low-pressure drain 58 via a drain passage 60. The valve element of solenoid valve 48 may be moved to the first position when solenoid valve 48 is energized by controller 38, and spring-biased to the second position when solenoid valve 48 is de-energized. It is contemplated that solenoid valve 48 may alternatively include multiple valve elements that together or separately control the flows of fluid into and out of hydraulic cylinder 46, if desired. When the valve element of solenoid valve 48 is moved to the first position, hydraulic cylinder 46 may be forced to its first position by the pressure of fluid provided by supply 54, thereby rotating air shutoff valve 30 toward the flow-blocking position. When the valve element of solenoid valve 48 is moved to the second position, hydraulic cylinder 46 may be drained of fluid and biased by spring 52 to move to its second position, thereby allowing spring 52 to also rotate air shutoff valve 30 toward the flow-blocking position. In this manner, air shutoff valve 30 may be movable in response to controller 38 energizing solenoid valve 48. Solenoid valve 48 may be continuously energized by controller 38 during normal engine system operations (i.e., during engine system operations not associated with a run-away). In other words, solenoid 48 may be energized to allow hydraulic cylinder 46 to hold air shutoff valve in the flow-passing position.

Controller 38 may selectively de-energize solenoid valve 48 based on the speed signal from sensor 40. Specifically, controller 38 may be configured to compare the speed of engine system 10, as sensed by sensor 40, to a threshold speed to determine if engine system 10 is experiencing an uncontrolled overspeed condition (i.e., to determine if engine system 10 is running away). When the signal from sensor 40 indicates that the speed of engine system 10 is above the threshold speed, controller 38 may de-energize solenoid valve 48 to terminate operation of engine system 10 and thereby protect engine system 10 from damage caused by excessive speeding.

In some embodiments, controller 38 may also be configured to affect operation of injectors 15 during an uncontrolled overspeed condition. That is, when controller 38 determines that engine system 10 is running away, in addition to causing air shutoff valve 30 to block airflow into combustion chambers 14, controller 38 may also cause injectors 15 to reduce or even stop injecting fuel (i.e., to inhibit fuel injection). By simultaneously inhibiting the injection of fuel and blocking air flow into combustion chambers 14, operation of engine system 10 may be terminated faster than by blocking air flow alone. This faster termination may result in less system damage caused by overspeeding.

Controller 38 may also be configured to affect operation of injectors 15 based on input from temperature sensor 42. Specifically, controller 38 may be configured to compare the temperature of exhaust downstream of cooler 36, as sensed by sensor 42, to a first threshold temperature and, when the sensed temperature exceeds the first temperature threshold, controller 38 may be configured to reduce an amount of fuel injected by injectors 15. In one embodiment, the first threshold temperature may be a temperature above which an explosive atmosphere surrounding engine system 10 may be likely to detonate, as outlined in governmental regulations, for example about 200° C. In one embodiment, the reduction of fuel injections may be substantially proportional to the sensed temperature or to a difference between the sensed and first threshold temperatures. It is contemplated that, when the sensed temperature exceeds a second threshold temperature greater than the first, injectors 15 may be completely inhibited by controller 38 from injecting any fuel, if desired. In this manner, temperature sensor 42 may provide failure protection functionality.

Air shutoff valve 30 may also be movable during a non-speed related failure of engine system 10. Specifically, air shutoff valve 30 may be configured to move toward the flow-blocking second position and terminate engine system operation when an electrical or hydraulic failure occurs. That is, during an electrical failure, the signal from controller 38 energizing solenoid valve 48 may be unintentionally lost. In this situation, the valve element of solenoid valve 48 may be spring biased toward the second position, thereby draining hydraulic cylinder 46 and causing spring 52 to move air shutoff valve 30 toward its flow-blocking second position. Similarly, during a hydraulic failure, the fluid pressure holding hydraulic cylinder 46 in its first position may be unintentionally reduced, thereby allowing spring 52 to retract hydraulic cylinder 46 and return air shutoff valve 30 to its flow-blocking second position. As described above, when air shutoff valve 30 is moved to its second position, operation of engine system 10 may be terminated, thereby limiting damage that could occur as a result of the electrical or hydraulic failure or as a result of overspeeding during the electrical or hydraulic failure. Accordingly, air shutoff valve 30 may be configured to move during the electrical and hydraulic failures in a manner in which damage to engine system 10 is limited and potential harmful conditions are not transferred to the surrounding atmosphere (i.e., air shutoff valve 30, solenoid valve 48, hydraulic cylinder 46, controller 38, and associated system architecture may have failure protection functionality).

After operation of engine system 10 is terminated by air shutoff valve 30, air shutoff valve 30 may need to be manually reset before engine system 10 can be restarted. In particular, because hydraulic cylinder 46 may require pressurized fluid to move air shutoff valve 30 to the flow-passing first position, and the fluid may only be pressurized by supply 54 during operation of engine system 10, air shutoff valve 30 may be unable to move to the flow-passing position without manual intervention. In the disclosed embodiment, a lever 62 may be provided for the manual resetting of air shutoff valve 30. Lever 62 may be fixedly connected to linkage member 50 and/or to air shutoff valve 30, such that manual manipulation of lever 62 results in rotation of air shutoff valve 30 to its flow-passing first position. After pushing lever 62 from a tripped position to a reset position to rotate air shutoff valve 30 from the flow-blocking second position to the flow-passing first position, a latch 64 may be used by the operator of engine system 10 to engage and retain lever 62 in the reset position.

Latch 64 may be a temporary latch utilized to retain lever 62 in the reset position only long enough for engine system 10 to be restarted. After engine system restart, when a pressure of the fluid discharged by supply 54 is elevated above a minimum pressure, latch 64 may disengage lever 62, thereby relinquishing control over movement of air shutoff valve 30 to controller 38 and actuator 44. Controller 38 may energize solenoid valve 48 to pass pressurized fluid to hydraulic cylinder 46, following shutdown of engine system 10, once an indication of engine system activation is received. In one embodiment, the indication of engine system activation may be received via an operator input device, for example an ignition switch 66. It should be noted that the indication of engine system operation may normally be received before the pressure of fluid from supply 54 is sufficient to release latch 64.

Figure 2:
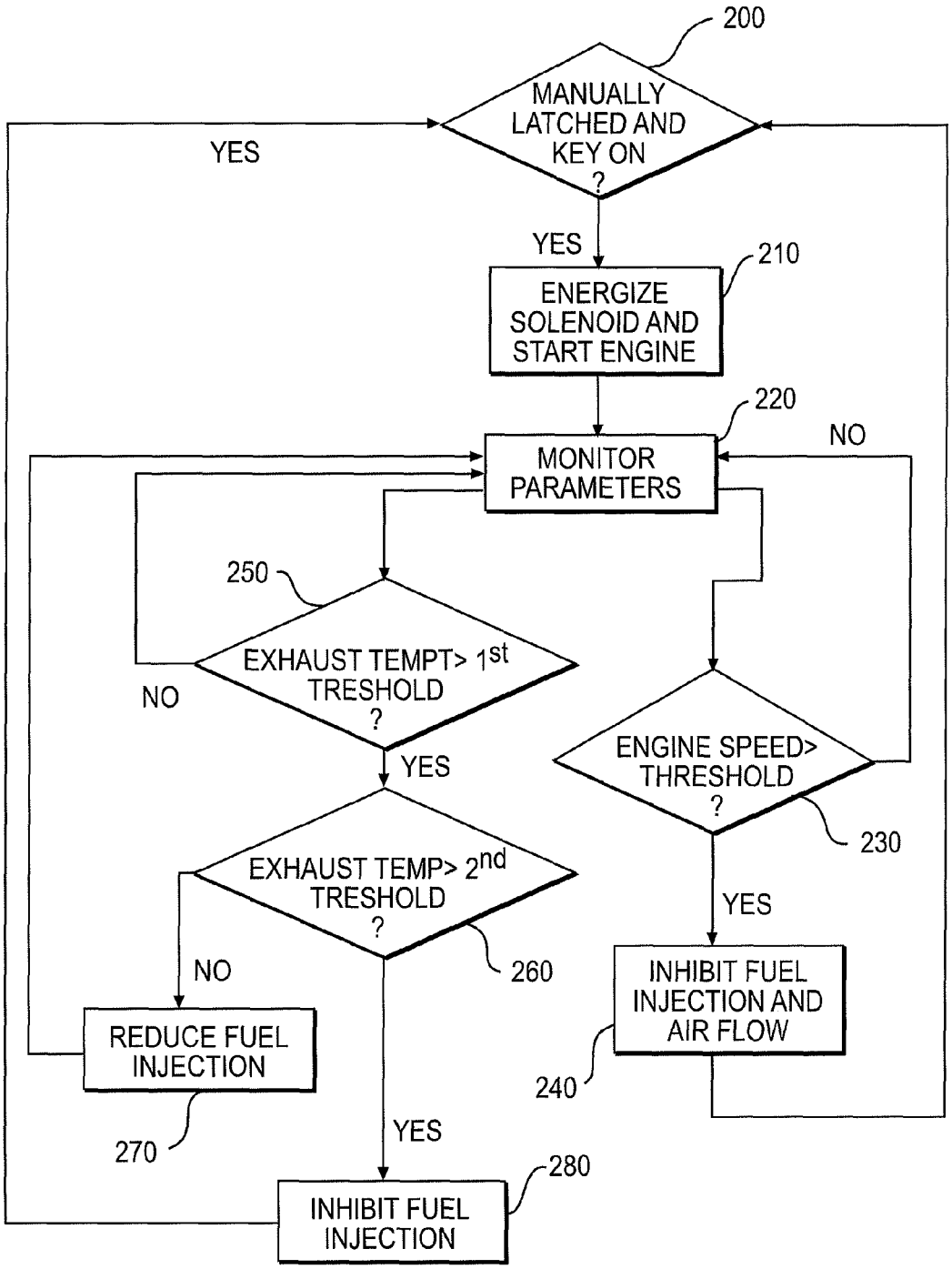
FIG. 2 is a flow chart depicting an exemplary method that may be performed by the engine system of FIG. 1.

FIG. 2 illustrates an exemplary method of controlling engine system 10. FIG. 2 will be discussed in more detail in the following section to further illustrate the disclosed concepts.

INDUSTRIAL APPLICABILITY

The engine system of the present disclosure may be particularly applicable to any situation where reliable termination of operation is important. Termination of engine system operation may be required in situations where an atmosphere surrounding the engine system is potentially explosive. In these situations, it may be possible for the engine system to ingest uncontrolled hydrocarbons from the atmosphere, thereby unintentionally increasing fueling of the engine system and driving the engine system to overspeed (i.e., thereby causing the engine system to run away). In addition, it may be possible in these situations for exhaust from the engine system to have a temperature sufficiently high to ignite the uncontrolled hydrocarbons, thereby causing detonation of the atmosphere. The disclosed engine system may provide reliable termination of operations during an overspeed condition by incorporating air shutoff valve failure protection functionality and/or temperature based injection control. Operation of engine system 10 will now be described.

Referring to FIG. 2, engine system 10 may only be started if latch 64 is first manually moved to hold lever 62 in the reset position before the operator activates ignition switch 66. That is, only when lever 62 is in the reset position, will engine system 10 be able to receive enough air to support combustion. Accordingly, controller 38 may first receive input from ignition switch 66 indicative of a desire for engine operation (Step 200), and then responsively energize solenoid valve 48 and attempt startup of engine system 10 (Step 210). If lever 62 is latched in the reset position at this point in time, engine system 10 may start and drive supply 54 to discharge fluid at a pressure sufficiently elevated to maintain lever 62 in the reset position. Once the pressure of fluid discharged by supply 54 is elevated, latch 64 may automatically disengage and lever 62 may be held in place by the force acting on hydraulic cylinder 46. It should be noted that other hardware and/or methods of temporarily holding lever 62 in the startup position may be utilized, if desired.

After startup of engine system 10, controller 38 may monitor various engine system parameters (Step 220). For example, controller 38 may monitor the speed of engine system 10 via sensor 40, and compare the sensed speed to the overspeed threshold (Step 230). If the sensed speed of engine system 10 is less than the overspeed threshold (Step 230: NO), control may return to step 220. However, if at Step 230, controller 38 determines that the sensed speed of engine system 10 is greater than the overspeed threshold (Step 230: YES), controller 38 may de-energize solenoid valve 48 and simultaneously inhibit the injection of fuel by injectors 15. As described above, de-energizing solenoid valve 48 may cause the fluid from within hydraulic cylinder 46 to drain to low pressure drain 58, thereby allowing spring 52 to move air shutoff valve 30 to its flow-blocking second position. By inhibiting the flow of air and fuel into combustion chambers 14, the operation of engine system 10 may be quickly terminated.

During operation of engine system 10, controller 38 may also be configured to monitor the temperature of exhaust from engine system 10 at a location downstream of exhaust cooler 36 via temperature sensor 42, and to compare the sensed temperature to the first threshold temperature (Step 250). If the sensed temperature is less than the first threshold temperature (Step 250: NO), control may return to step 220. However, if at Step 220, controller 38 determines that the sensed temperature is greater than the first threshold temperature (Step 250: YES), controller 38 may then determine if the sensed temperature is greater than the second threshold temperature (Step 260). If the sensed temperature is less than the second threshold temperature (Step 260: NO), controller 38 may cause injectors 15 to inject a reduced amount of fuel into combustion chambers 14 in an attempt to lower the temperatures without significantly affecting engine system operation (Step 270), and control may return to step 220. If, however, the sensed temperature is greater than the second threshold temperature (Step 260: YES), controller 38 may inhibit fuel injection into combustion chambers 14. The reduction and/or inhibiting of fuel injection into combustion chambers 14 may function to reduce exhaust temperatures and/or completely shut down engine system 10.

Because engine system 10 may have failure protection functionality, engine system 10 may be capable of shutdown even during failure conditions associated with systems utilized to shut engine system 10 down. In particular, air shutoff valve 30 may be capable of blocking intake duct 22 and thereby terminating engine system operations when commanded to do so in response to an overspeed condition as well as in response to a hydraulic or electrical failure. The ability to shut engine system 10 down during a hydraulic and electrical failure may help ensure that engine system 10 is protected from damage caused by the overspeed condition even when other systems have failed. In addition, the ability to integrate control of air shutoff valve 30 together with engine control, as opposed to a separate add-on type of system, may provide failure protection functionality not available with add-on systems.

It will be apparent to those skilled in the art that various modifications and variations can be made to the engine system of the present disclosure without departing from the scope of the disclosure. Other embodiments will be apparent to those skilled in the art from consideration of the specification and practice of the engine system disclosed herein. It is intended that the specification and examples be considered as exemplary only, with a true scope of the disclosure being indicated by the following claims and their equivalents.

What is claimed is:

1. An engine system, comprising:

an engine;

an intake duct fluidly connected to the engine;

a valve disposed within the intake duct and movable between a flow-passing first position, and a flow-blocking second position;

an actuator selectively activated to move the valve from the second position toward the first position;

a biasing element configured to move the valve from the first position toward the second position when the actuator is deactivated;

a sensor configured to sense an operating condition of the engine and generate a signal indicative of the operating condition; and a controller in communication with the actuator and the sensor, the controller being configured to:

receive an input indicative of engine activation;

activate the actuator based on the input;

make a determination that the operating condition of the engine has deviated from a desired operating condition based on the signal; and deactivate the actuator based on the determination.

2. The engine system of claim 1, further including an ignition switch, wherein the input is associated with activation of the ignition switch by an operator.

3. The engine system of claim 1, wherein:

the sensor is a speed sensor; and the operating condition is an overspeed condition.

4. Then engine system of claim 1, wherein the actuator includes:

a hydraulic cylinder configured to cause the valve to rotate; and a solenoid valve configured to selectively meter pressurized fluid to the hydraulic cylinder.

5. The engine system of claim 4, wherein the actuator is configured to move the valve toward the second position during an electrical failure and a hydraulic failure of the engine system.

6. The engine system of claim 1, further including a manual reset mechanically connected to the valve and utilized to move the valve to and hold the valve in the first position during startup of the engine.

7. The engine system of claim 6, wherein the manual reset includes:

a lever fixedly connected to the valve and movable between a tripped position and a reset position; and a latch configured to retain the lever in the reset position.

8. The engine system of claim 7, wherein the latch is a temporary latch and configured to retain the lever in the reset position only until the engine becomes operational and the actuator overrides the latch.

9. The engine system of claim 7, further including at least one fuel injector configured to inject fuel into the engine, wherein the controller is in further communication with the at least one fuel injector and configured to inhibit the at least one fuel injector from injecting fuel based on the determination at about the same time that the actuator is deactivated.

10. The engine system of claim 9, further including:

an exhaust cooler configured to receive and cool exhaust from the engine; and a temperature sensor configured to generate a temperature signal indicative of a temperature of exhaust downstream of the exhaust cooler, wherein the controller is in further communication with the temperature sensor and configured to reduce an amount of fuel injected by the at least one fuel injector when the temperature signal indicates a temperature of the exhaust exceeding a threshold.

11. The engine system of claim 10, wherein the threshold is a first temperature threshold, and the controller is further configured to inhibit fuel injection fuel injection when the temperature signal indicates a temperature of the exhaust exceeding a second higher temperature threshold.

12. An engine system, comprising:

an engine;

an intake duct fluidly connected to the engine;

a valve disposed within the intake duct and movable between a flow-passing first position, and a flow-blocking second position;

a hydraulic cylinder selectively pressurized with fluid to move the valve from the second position toward the first position;

a solenoid valve configured to selectively pass pressurized fluid to the hydraulic cylinder when energized, and drain pressurized fluid from the hydraulic cylinder when de-energized;

a spring configured to move the valve from the first position toward the second position when the hydraulic cylinder is drained of pressurized fluid;

a speed sensor configured to sense a speed of the engine and generate a signal indicative of the speed; and a controller in communication with the solenoid valve and the speed sensor, the controller being configured to:

make a determination that the engine is experiencing an overspeed condition based on the signal; and de-energize the solenoid valve based on the determination.

13. The engine system of claim 12, further including:

a manual reset lever fixedly connected to the valve and movable between a tripped position and a reset position; and a latch configured to retain the manual reset lever in the reset position, wherein the latch is a temporary latch and configured to retain the manual reset lever in the reset position only until the engine becomes operational and a pressure of the fluid supplied to the hydraulic cylinder exceeds a minimum pressure.

* * * * *